US009716337B2

(12) United States Patent
Keuten et al.

(10) Patent No.: US 9,716,337 B2
(45) Date of Patent: Jul. 25, 2017

(54) CONNECTING DEVICE HAVING A FLEXIBLE CIRCUIT BOARD WITH ELECTRICAL LINES CONNECTED TO ELECTRICAL CONTACTS

(71) Applicant: CONTI TEMIC MICROELECTRONIC GMBH, Nuremberg (DE)

(72) Inventors: Matthias Keuten, Altdorf (DE); Andreas Voegerl, Parsberg (DE); Juergen Henniger, Erlangen-Dechsendorf (DE); Matthias Wieczorek, Neunkirchen am Sand (DE); Lisa-Maria Wittmann, Alesheim (DE)

(73) Assignee: Conti Temic microelectronic GmbH, Nuremberg (DE)

( * ) Notice: Subject to any disclaimer, the term of this patent is extended or adjusted under 35 U.S.C. 154(b) by 0 days.

(21) Appl. No.: 15/100,822

(22) PCT Filed: Nov. 28, 2014

(86) PCT No.: PCT/EP2014/075915
§ 371 (c)(1),
(2) Date: Jun. 1, 2016

(87) PCT Pub. No.: WO2015/082333
PCT Pub. Date: Jun. 11, 2015

(65) Prior Publication Data

US 2016/0301155 A1 Oct. 13, 2016

(30) Foreign Application Priority Data

Dec. 6, 2013 (DE) ..... 10 2013 225 142

(51) Int. Cl.
*H01R 13/66* (2006.01)
*H01R 13/52* (2006.01)
*H01R 12/62* (2011.01)

(52) U.S. Cl.
CPC ..... *H01R 13/5213* (2013.01); *H01R 12/62* (2013.01)

(58) Field of Classification Search
CPC ..... H01R 12/62; H01R 13/52; H01R 13/521; H01R 13/5213; H01R 13/66; H01R 13/665
(Continued)

(56) References Cited

U.S. PATENT DOCUMENTS 3,214,713 A * 10/1965 Strobel ..... H01R 12/59 439/418
4,526,432 A * 7/1985 Cronin ..... H01R 12/777 439/320
(Continued)

FOREIGN PATENT DOCUMENTS

DE 10051945 C1 11/2001
WO 2008049724 A1 5/2008

*Primary Examiner* — Chandrika Prasad
(74) *Attorney, Agent, or Firm* — Laurence A. Greenberg; Werner H. Stemer; Ralph E. Locher

(57) ABSTRACT

A connecting device for electrically connecting electrical lines to electrical contacts includes a flexible circuit board or printed circuit board, a base support, and a cover. The electrical lines or conductors are disposed on the flexible circuit board. The flexible circuit board has a contacting-making region, in which at least one electrical line is electrically connected to at least one electrical contact. The electrical contacts are disposed on the base support. The flexible circuit board is disposed between the base support and the cover and the base support and the cover form a sealed housing for the contacting-making region.

11 Claims, 1 Drawing Sheet

(58) Field of Classification Search
USPC ..... 439/467, 620.15, 271–275, 367
See application file for complete search history.

(56) References Cited

U.S. PATENT DOCUMENTS

| | | | | |
|---|---|---|---|---|
| 6,200,142 | B1 * | 3/2001 | Soh | H01R 12/61 439/67 |
| 6,409,531 | B1 * | 6/2002 | Millard | H01R 13/22 439/289 |
| 7,048,564 | B1 * | 5/2006 | Hinze | B60R 16/0239 361/742 |
| 7,462,035 | B2 * | 12/2008 | Lee | H01R 12/592 439/121 |
| 8,529,276 | B2 * | 9/2013 | Esquivel | H01R 12/716 439/492 |
| 8,956,166 | B2 * | 2/2015 | Ritner | H01R 12/79 439/84 |
| 9,312,620 | B2 * | 4/2016 | Chen | H01R 12/79 |
| 2007/0026695 | A1 | 2/2007 | Lee et al. | |
| 2013/0323946 | A1 | 12/2013 | Ritner | |

* cited by examiner

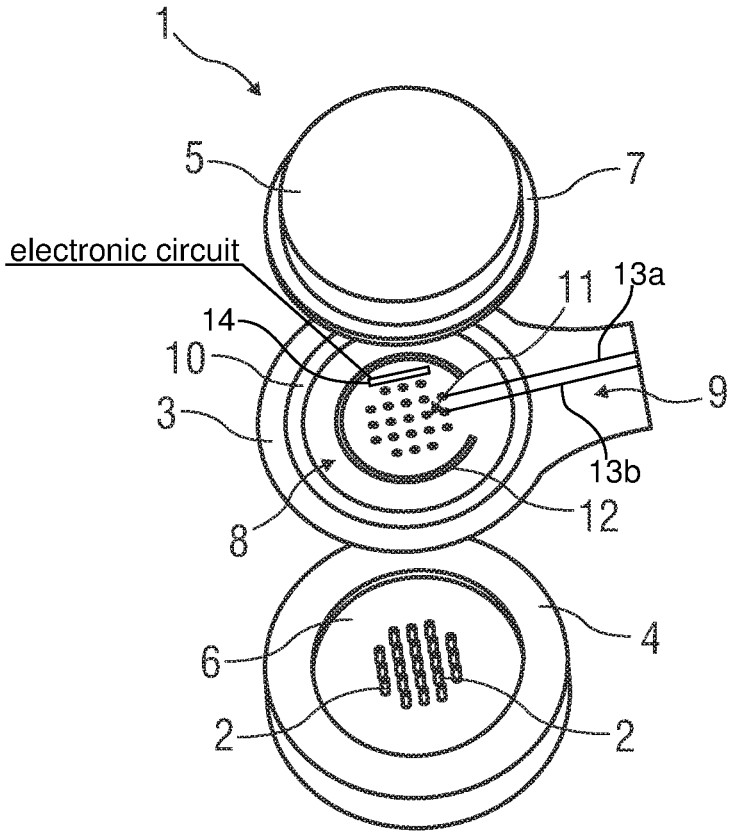
1
5
7
electronic circuit
11
13a
14
10
9
3
13b
12
8
4
6
2
2

CONNECTING DEVICE HAVING A FLEXIBLE CIRCUIT BOARD WITH ELECTRICAL LINES CONNECTED TO ELECTRICAL CONTACTS

BACKGROUND OF THE INVENTION

Field of the Invention

The invention relates to a connecting device for electrically connecting electrical lines to electrical contacts.

Electronic apparatuses for example control apparatuses, generally contain a large number of electronic components which are electrically connected to other components outside the apparatus. The electrical connections often have to be protected against environmental influences and mechanical influences. For example, in the construction of automotive transmissions and engines, electrical connections which have to be protected against aggressive media, oils and swarf are used both on and in the transmission or engine.

BRIEF SUMMARY OF THE INVENTION

The invention is based on the object of specifying an improved connecting device for electrically connecting electrical lines to electrical contacts.

According to the invention, the object is achieved by the features of the connecting device described below.

Advantageous refinements of the invention are the subject matter of the dependent claims.

A connecting device according to the invention for electrically connecting electrical lines to electrical contacts comprises a flexible circuit board, a base support and a cover. The electrical lines are arranged on the flexible circuit board. The flexible circuit board has a contact-making region in which at least one electrical line is electrically connected to at least one electrical contact. The electrical contacts are arranged on the base support. The flexible circuit board is arranged between the base support and the cover, wherein the base support and the cover form a sealed housing of the contact-making region.

The contact-making region, in which the electrical lines of the flexible circuit board are connected to the electrical contacts, is shielded from the surrounding area, for example from aggressive media, oils and swarf, by the housing which is formed by the base support and the cover. As a result, the electrical connections of the electrical lines to the electrical contacts are advantageously protected against damaging environmental influences, and therefore said connections can also be used, for example, in transmissions or engines of vehicles.

The arrangement of the electrical lines on a flexible circuit board, preferably in the form of conductor tracks, allows physical tolerances which can occur for reasons of production or due to stresses or changes in temperature between the electrical lines and/or the circuit board and the electrical contacts, the base support and/or the cover to be compensated owing to the flexibility of the circuit board. Forces and stresses which can act on the electrical connections between the electrical lines and electrical contacts and compromise the stability of said connections are advantageously avoided owing to said tolerance compensation.

One refinement of the invention makes provision for the flexible circuit board to have a connecting region which is cohesively connected to the base support and the cover and surrounds the contact-making region. As a result, the flexible circuit board is fixed between the base support and the cover without the contact-making region itself being fixedly connected to the base support or the cover, so that the contact-making region continues to remain flexible in the housing which is formed by the base support and the cover and contributes to the tolerance compensation mentioned above.

In this refinement of the invention, the connecting region is preferably cohesively connected to the base support and the cover by lamination or adhesive bonding or welding in each case. This advantageously allows a sealed connection between the flexible circuit board and the base support and the cover, so that the interior of the housing which is formed by the base support and the cover is shielded from the surrounding area.

Furthermore, the flexible circuit board preferably has a slot-like opening which is surrounded by the connecting region. The flexibility of the circuit board is increased, and therefore the tolerance compensation mentioned above is further improved, owing to an opening of this kind.

In this case, the slot-like opening is preferably arranged outside the contact-making region. As a result, the slot-like opening is arranged between the contact-making region and the connecting region and allows displacement of the contact-making region in relation to the connecting region and therefore within the housing which is formed by the base support and the cover, said displacement further improving the tolerance compensation.

A further refinement of the invention makes provision for the electrical contacts to be in the form of metal contact pins or in the form of a lead frame. This advantageously allows proven techniques for electrically connecting the electrical lines of the flexible circuit board, in particular conductor tracks, to the electrical contacts to be used.

A further refinement of the invention makes provision for the cover to be manufactured from a plastic, a steel, a metal, a metal alloy or a film/foil. In this case, the choice of material is matched to the respective requirements dictated by the environment in which the connecting device is intended to be used.

The base support is preferably manufactured from a plastic. This advantageously makes it easier to arrange the electrical contacts on the base support.

At least one electrical line is preferably connected to at least one electrical contact by soldering, adhesive bonding, welding and/or pressing-in since this advantageously allows stable electrical connections between electrical lines and electrical contacts.

Furthermore, the flexible circuit board preferably has an outer region which is arranged outside the housing of the contact-making region, which housing is formed by the base support and the cover, and at least one electrical line is routed out of said housing by means of said outer region. As a result, electrical contact can advantageously be made with electrical lines and electrical contacts of the connecting device from the outside, that is to say with the housing closed.

Furthermore, the flexible circuit board can be fitted with an electronic circuit. As a result, the functionality of the flexible circuit board and the connecting device can advantageously be extended and matched to the respective application.

BRIEF DESCRIPTION OF THE DRAWING

Exemplary embodiments of the invention will be explained in greater detail below with reference to a drawing in which the single FIGURE shows an exploded perspective illustration of a connecting device 1 for electrically connecting electrical lines to electrical contacts 2. The connecting device 1 comprises a flexible circuit board 3, a base support 4 and a cover 5.

DESCRIPTION OF THE INVENTION

The base support 4 is in the form of a substantially cylindrical base and is manufactured, for example, from a plastic. A covering area of the surface of the base support 4, which covering area faces the flexible circuit board 3, has a circular recess 6 in the center, the electrical contacts 2 being arranged in said recess. In the exemplary embodiment illustrated in the FIGURE, the electrical contacts 2 are in the form of metal connection pins. As an alternative, the electrical contacts 2 can be realized by a lead frame.

In the exemplary embodiment illustrated in the FIGURE, the cover 5 is in the form of a hat and has a hat brim section 7, the bottom face of said hat brim section facing the flexible circuit board 3. The cover 5 is manufactured, for example, from a plastic, a steel, a metal or a metal alloy. As an alternative, the cover 5 can also be in the form of a film/foil.

The flexible circuit board 3 is fitted with the electrical lines in the form of conductor tracks. Only two electrical lines 13*a* and 13*b* are shown. However, it should be understood that a greater number of electrical lines can be provided. The flexible circuit board 3 has an inner region 8 which is arranged between the base support 4 and the cover 5 and is substantially in the form of a circular disk, and an outer region 9 which adjoins the inner region 8.

The inner region 8 of the flexible circuit board 3 has a ring-shaped connecting region 10 which is cohesively connected to an edge region of the covering area of the base support 4, which edge region surrounds the recess 6, on one side and is cohesively connected to the bottom face of the hat brim section 7 of the cover 5 on the other side. The cohesive connections between the connecting region 10 and the base support 4 and the cover 5 are each established, for example, by lamination, adhesive bonding or welding in this case.

The connecting region 10 of the flexible circuit board 3 surrounds a contact-making region 11 in which electrical lines of the flexible circuit board 3 are electrically connected to electrical contacts 2, wherein a connection between an electrical line and an electrical contact 2 is preferably established by soldering.

The flexible circuit board 3 has a slot-like opening 12, which surrounds the contact-making region 11 in a sickle-like manner, between the connecting region 10 and the contact-making region 11.

The base support 4 and the cover 5 form a sealed housing for the contact-making region 11 of the flexible circuit board 3. The outer region 9 of the flexible circuit board 3 is situated outside this housing and routes electrical lines out of the housing.

In addition to the electrical lines, the flexible circuit board 3 can also be fitted with components of an electronic circuit 14.

The connecting device 1 can be connected to other components, for example by adhesive bonding, lamination or laser welding.

LIST OF REFERENCE SYMBOLS

1 Connecting device
2 Electrical contact
3 Flexible circuit board
4 Base support
5 Cover
6 Recess
7 Hat brim section
8 Inner region
9 Outer region
10 Connecting region
11 Contact-making region
12 Opening

The invention claimed is:

1. A connecting device for electrically connecting electrical lines to electrical contacts, the connecting device comprising:

a cover;

a base support on which the electrical contacts are disposed; and a flexible circuit board on which the electrical lines are disposed, said flexible circuit board being disposed between said base support and said cover, and said flexible circuit board having a contact-making region in which at least one of the electrical lines is electrically connected to at least one of the electrical contacts;

said base support and said cover forming a sealed housing for said contact-making region; and said flexible circuit board having a slot-shaped opening surrounding at least three sides of said contact-making region.

2. The connecting device according to claim 1, wherein said flexible circuit board has a connecting region being cohesively connected to said base support and to said cover and surrounding said contact-making region.

3. The connecting device according to claim 2, wherein said connecting region is cohesively connected to each of said base support and said cover by lamination or adhesive bonding or welding.

4. The connecting device according to claim 2, wherein said slot-shaped opening is surrounded by said connecting region.

5. The connecting device according to claim 4, wherein said slot-shaped opening is disposed outside said contact-making region.

6. The connecting device according to claim 1, wherein said electrical contacts are formed as metal contact pins or a lead frame.

7. The connecting device according to claim 1, wherein said cover is formed of plastic, steel, a metal, a metal alloy or a film or a foil.

8. The connecting device according to claim 1, wherein said base support is formed of plastic.

9. The connecting device according to claim 1, wherein the at least one electrical line is connected to the at least one electrical contact by at least one of soldering or adhesive bonding or welding or pressing-in.

10. The connecting device according to claim 1, wherein said flexible circuit board has an outer region disposed outside said housing for said contact-making region, and said outer region routes at least one of the electrical lines out of said housing formed by said base support and said cover.

11. The connecting device according to claim 1, wherein said flexible circuit board is fitted with an electronic circuit as well as the electrical lines.

* * * * *